US006360757B1

(12) United States Patent
Bohrer

(10) Patent No.: US 6,360,757 B1
(45) Date of Patent: Mar. 26, 2002

(54) INSERTION AND CONTROL APPARATUS

(76) Inventor: Lee A. Bohrer, 306 Terrace View West, Mankato, MN (US) 56001

( * ) Notice: Subject to any disclaimer, the term of this patent is extended or adjusted under 35 U.S.C. 154(b) by 0 days.

(21) Appl. No.: 09/434,081

(22) Filed: Nov. 5, 1999

(51) Int. Cl.[7] ..... B08B 9/02

(52) U.S. Cl. ..... 134/113; 134/169 C; 134/168 C; 134/167 C; 242/129.6

(58) Field of Search ..... 134/167 C, 168 C, 134/169 C, 113; 15/104.05, 104.061, 104.095, 104.333; 242/129, 168, 559.1, 129.6, 391; 137/355.27, 580; 348/84; 414/538

(56) References Cited

U.S. PATENT DOCUMENTS

| | | | | | |
|---|---|---|---|---|---|
| 1,076,870 | A | * | 10/1913 | Dahl | 15/104.33 |
| 1,107,250 | A | * | 8/1914 | Bigham | 15/104.33 |
| 1,722,512 | A | * | 7/1929 | Wilt | 15/104.33 |
| 1,807,549 | A | * | 5/1931 | Reber | 15/104.33 |
| 2,037,103 | A | * | 4/1936 | Yohn | 15/104.33 |
| 2,199,651 | A | * | 5/1940 | Quick | 15/103.11 |
| 2,247,004 | A | * | 6/1941 | Sullivan | 14/104.33 |
| 2,355,733 | A | * | 8/1944 | Johnson et al. | 15/104.33 |
| 2,488,039 | A | | 11/1949 | Sketchley | |
| 2,659,540 | A | | 11/1953 | Sketchley | |
| 3,098,251 | A | * | 7/1963 | Stewart, Jr. | 15/104.33 |
| 3,175,574 | A | | 3/1965 | Morford | |
| 3,254,851 | A | * | 6/1966 | Caperton | 15/104.33 |
| 3,655,122 | A | * | 4/1972 | Brown et al. | 134/167 C |
| 3,662,421 | A | * | 5/1972 | Caperton | 15/104.33 |
| 3,859,687 | A | * | 1/1975 | Caperton | 15/105.33 |
| 3,887,163 | A | * | 6/1975 | Prange | |
| 3,920,194 | A | * | 11/1975 | Parsen | |
| 3,959,840 | A | * | 6/1976 | Sato | 134/167 C |
| 4,012,002 | A | | 3/1977 | Mcdonald et al. | |
| 4,676,267 | A | | 6/1987 | Wang | |
| 4,691,723 | A | * | 9/1987 | Mierswa et al. | 134/167 C |
| 4,773,113 | A | | 9/1988 | Russell | |
| 4,993,449 | A | | 2/1991 | Stutzman et al. | |
| 5,109,882 | A | | 5/1992 | Eley | |
| 5,284,181 | A | | 2/1994 | Bloch | |
| 5,754,220 | A | * | 5/1998 | Smalser, Sr. | |
| 5,806,787 | A | * | 9/1998 | Schneider | |
| 5,862,561 | A | * | 1/1999 | Irwin | |
| 5,996,159 | A | * | 12/1999 | Irwin | |

FOREIGN PATENT DOCUMENTS

| | | | | |
|---|---|---|---|---|
| CA | 860556 | * | 1/1971 | 15/104.33 |
| DE | 225391 | * | 9/1910 | 15/104.33 |
| FR | 2611539 | * | 9/1988 | 15/104.33 |
| GB | 5116 | * | of 1906 | 15/104.33 |

* cited by examiner

*Primary Examiner*—Frankie L. Stinson
(74) *Attorney, Agent, or Firm*—Moore & Hansen

(57) ABSTRACT

An insertion and control apparatus for use with a pipe carrying fluids and having turns and sludge therein to repair a piping system. The apparatus includes a storage and aiming device rotatably mounted about a first axis for winding and unwinding a stiff conduit in a storage and aiming device. The storage and aiming device is rotatably mounted on a frame about a second axis being offset relative to the first axis for controlling the direction of the stiff conduit in the pipe. The storage and aiming device is capable of being connected in communication from the inlet of the storage and aiming device through the second axis and the first axis to the connected end of the stiff conduit. The insertion control apparatus provides a way to control the stiff conduit around turns with less localized damage to the conduit to prolong the life of the conduit system.

34 Claims, 2 Drawing Sheets

24
54
52
60
56
20
50
10
62
12
110
14
114
38
86
64
36
98
40
48
28
106
116
96
18
78
120
122
70
42
6
28
90
22
76
24
84
88
82
44
118
112
58
80
74
72
4

INSERTION AND CONTROL APPARATUS

This invention relates generally to insertion and control apparatuses used with substantially stiff conduit having turns and carrying fluids. More particularly, the invention relates to such insertion and control apparatuses capable of being connected in communication from an inlet of the storage device through a second axis and a first axis to a connected end of the stiff conduit.

BACKGROUND

The inspection and clearance functions of pumping system repair utilize devices that may be adequate but sometimes suffer from a number of disadvantages in use. Inspecting a plumbing system at a residence to find blockage may begin in the kitchen of a residence. The primary device used for inspection looks like a dolly with wheels and handles. A reel is rotatably mounted about a first axis onto the dolly. Coaxial cable having a camera at the free end of the coaxial cable is wound around the reel. A relatively tall, wide, and bulky dolly is then lifted from the service truck, rolled through possibly a living room into the kitchen. Underneath the kitchen sink, a trap clean out is opened on the fixture trap at a dip between the inlet and outlet of the pipe. Extending from the trap clean-out into the kitchen area is a foot and a half to two foot extender pipe. The camera and coaxial cable is extended through the extender pipe and into the plumbing system past as many as four or more 90° turns before the camera reaches the blockage in the pipe. Merely shoving the cable into the pipe will not work because the cable needs to be controlled and turned in the desired direction. In the maze of plumbing pipes, the cable must extend from inside the kitchen through the kitchen sink trap to the potential blockage location over 70 feet. So, beyond that first turn that stopped the forward progress of the cable media, perhaps four to ten additional turns in the pipe must be navigated around and controlled by aiming the cable to reach the blockage.

For example, when the camera and cable reach a tee the operator needs to aim the cable in the desired direction by twisting the cable immediately outside the extender pipe 360° or more until the proper angle is felt by the operator and the hose moves forward again in the proper direction. Consequently, for each additional turn, additional twisting and torquing is applied to the cable in a localized area on the cable. To turn the free end of the cable to the right in the tee located 70 feet from the kitchen, the operator unwinds additional cable from the dolly and keeps twisting the cable up by hand in the mid-portion of the cable in the kitchen area in a clock-wise rotation until the front free end of the cable twists sufficiently to turn in the correct position. Meanwhile, all that twisting urges the rear portion of the cable to twist in an equal and opposite reaction from the area of the localized hand twisting but the cable cannot because the rear end of the cable is held in place by the single, first axis, reel on the dolly in the kitchen.

The accumulated twisting of the cable at a one or two hand width localized area on the cable causes fatigue, wear and damage to the cable. Occasionally puddles of water and sludge accumulate on the floor where the electrical device is used. Damaged and exposed insulation on a coaxial cable that is hooked up to the household power supply may present the danger of shock or electrocution. The economic disadvantage to such localized hand twisting that damages the cable is the shorter life cycle of the product with its accompanying replacement costs of the cable, the turn around time from sending the cable to the manufacturers several states away for repairs, and the down-time costs. The inconvenience to the operator of this device includes a significant amount of manual effort and resulting fatigue from the entire process. To control and aim the direction of the camera and free end of the cable around each turn, the operator may have to twist a long rigid cable, many feet long, by hand in the mid-portion of the cable to turn and twist the front end of the cable while fighting and overcoming the opposing resistance to the torque to the operator from the rear coiled end of the cable fixed to the reel on the dolly. The inconvenience to the client of the present device includes the mess of sludge created on the kitchen floor from retracting 75 feet of cable that may be full of muck from the dirty pipe into the kitchen onto an exposed open face reel. As the cable is rewound, many feet of cable accumulates and becomes encased with muck in the pipe. As the sludge covered cable exits the kitchen trap, crosses over and onto the floor, then back up to the reel, sludge can be wiped off that cable onto the floor and muck flies off the cable from the rotating reel spraying onto a food preparation area.

The width and bulk of the inspection dolly is even a bigger disadvantage in other locations beside the kitchen. For example, the dolly device in a small bathroom would be hard to maneuver underneath a sink or in between a toilet and a shower. Similarly, the wide bulky inspection dolly would be hard to maneuver in the basement around obstacles such as in between hot water tank and furnace and other narrow enclosed areas.

The clearance function in a residential plumbing system may involve some large and bulky equipment.

To clear a blockage in the plumbing at a residence from the kitchen with a high pressure hose system involves a high pressure truck and a high pressure hose on a dolly. For example, a high pressure truck would be parked in the driveway and have a hose extending from the truck leading into the home through possibly a living room into kitchen. A high pressure hose device may include a dolly having a reel rotatably mounted on the dolly for winding and unwinding approximately 75 feet of high pressure hose about the reel. The bulky hose dolly is carried from the truck through the font door to the middle of the kitchen and connected to the high pressure hose that leads out to the truck outside. A trap underneath the kitchen sink is opened. An extender pipe that extends about 1.5 feet to 2 feet into the kitchen area is inserted into the trap. The high pressure hose with a jet propelled nozzle at the free end of the hose is pulled and unwound from the dolly and then inserted through the extender pipe into the plumbing system. There can be as many as four or more 90° turns before the nozzle reaches the blockage in the pipe.

The problem encountered at each turn when navigating through the maze of turns in the pathway to the blockage is how to control and to aim the free end of the high pressure hose at each of the many turns, unseen and possibly 75 feet away from the operator which is stopping the forward progress of the high pressure hose. Shoving the hose further or harder does not work. At the unseen turn which may possibly be 75 feet from the operator in the kitchen, there could be a 90° elbow, a tee, a cross, or a 45° lateral joint which requires controlling the direction of the free end to not only proceed in the proper direction but also to proceed at all around the 90° pipe turn. Because high pressure hoses are too stiff to bend around a corner even with a jet propelled nozzle or to turn by pushing force, some other devices may be used that include a spring coiled snake that is rotated mechanically by a machine which drills the coiled snake around a turn. However, those devices suffer from the disadvantage of damaging the pipe by abrading the pipe interior.

A high pressure hose has a rigid stiff wall that will not turn in a pipe of its own volition even if it is pushed hard inside a pipe when encountering a 90° angle turn. The hose can be moved around its stopped position by the operator in the kitchen at the extender pipe by twisting the hose by hand 360° or more until the proper angle is felt and the high pressure hose moves forward again. Several additional turns in the pipe must be navigated around by controlling the hose before reaching the blockage. Consequently, additional twisting and torquing is applied to the hose in localized areas at about one or two hand width lengths. Each twisting torque motion made by the operator in the midportion of the high pressure hose to control and move the direction of the free end of the hose in the front makes the rear end of the hose want to twist in equal and opposite reaction but cannot. The rear end of the hose is fixed by a single axis reel on the dolly.

The safety danger of the accumulated twisting on the rigid high pressured hose in a localized area is that it causes fatigue, wear and damage to the high pressure hose. A damaged high pressure hose operating under 4,000 lb/in$^2$ can be dangerous. If the high pressure hose explodes, it can lacerate the operator's hands or damage the operator's eyes. The diminished life cycle of a product from all the twisting on the hose has the economic disadvantage of the cost of replacement, the amount of turn around time from sending the hose to a manufacturer several states away for replacement and the down time costs. The current system also suffers from the disadvantage that while the operator is facing toward and focusing on the extender pipe and twisting the hose with his hands, the high pressure hose near the hose dolly may twist and kink under high pressure behind the operator's back out of sight presenting potential injury to the operator.

To accomplish the necessary turn and direction control required by the front end of the high pressure hose, the operator has to twist and to create a sufficient amount of torque over the length of a long rigid high pressure hose by hand while simultaneously fighting the main rear portion of the high pressure hose wound up on the reel that resists the torque created by the user. Finally, an inconvenience to the client of the current system is the mess created in the kitchen as the sludge encased 75 feet of hose is rewound out of the pipe onto the floor into the hose reel where the muck can fly off the hose from the rotating reel. It would be desirable to have a means that would be less messy, less bulky for maneuvering, and would improve the ease of control of the hose. It would also be desirable to provide hose control with less localized damage to the hose.

SHORT STATEMENT OF THE INVENTION

It, therefore, is an object of this invention to provide an insertion and control apparatus for use with a substantially stiff conduit in a pipe having turns and carrying fluids that improves the ease of controlling the stiff conduit.

Another object is to provide a way to control the stiff conduit around turns with less localized damage to the conduit to prolong the life of the conduit.

A further object of the invention is the provision of neater and more compact devices for inspecting and clearing obstructions in a plumbing system.

Accordingly, an insertion and control apparatus of the present invention includes a frame and a storage and aiming device. The insertion and control apparatus is made for use with a substantially stiff conduit including a free end having a curl nearby and a connected end for use in a pipe having turns and usable for carrying fluids. The storage and aiming device is rotatably mounted upon a first axis winding and unwinding the conduit storage and aiming device. The aiming device is rotatably mounted on the frame about the second axis. The second axis is offset relative to the first axis for controlling the direction of the stiff conduit in the pipe. The aiming device includes an inlet and is capable of being connected in communication from the inlet of the storage and aiming device through the second axis and the first axis to the connected end of the stiff conduit. The frame includes an arm. The arm is mounted onto the frame into the central plane for guarding the conduit on the reel from damage and for grasping to transport the apparatus.

The storage and aiming device also includes a reel. The reel can have a width that is less than the radius of the reel and defines a central plane. The frame includes at least two legs that are foldably and rotatably mounted about the second axis onto the frame into the central plane.

The storage and aiming device has a first position for dispensing conduit straight ahead into the pipe while the conduit is stopped by the turn inside the pipe. The aiming device also has a second position offset from the first position about the second axis for turning the conduit around the turn to proceed ahead. The aiming device also has a conduit rewinding third position that is offset from the second position about the second axis for turning the conduit around the turn to proceed backward for rewinding the conduit into the storage and aiming device. The rotatably mounted about a first axis storage and aiming device has a water-tight connection.

The storage and aiming device includes a housing that is carried by the storage and aiming device for rotation with the storage and aiming device about a second axis. The housing surrounds the reel for containing the sludge.

The insertion and control apparatus may include a predetermined length of stiff conduit. The stiff conduit can be elastically bendable yet substantially stiff. The stiff conduit may include a free end and a connected end. The stiff conduit has a continuous and water-proof periphery. The predetermined length of the stiff conduit is constructed and arranged to be wound on and unwound from the reel. The stiff conduit has a curl near the free end of the stiff conduit. The stiff conduit is constructed and arranged to carry fluids there along in fluid flow relationship therewith. The stiff conduit is constructed and arranged to retain liquid at a pressure over 100 lb/in$^2$.

The stiff conduit further comprises a utilization device connected to the free end of the stiff conduit. The utilization device is a nozzle constructed and arranged for liquid. More specifically, the nozzle is constructed and arranged for liquid at a pressure over 100 lb/in$^2$ whereby the nozzle has rearwardly projected apertures for propelling forward the nozzle and the attached high pressure hose.

In another embodiment of the invention, the rotatably mounted about a first axis storage and aiming device has an electrical connection. The stiff conduit in this embodiment of the invention is a cable media. The cable media may include a coaxial cable or a fiber optic cable. The utilization device can be a camera such as a video camera.

BRIEF DESCRIPTION OF THE DRAWINGS

Other objects, features and advantages of the present invention will become more fully apparent from the following detailed description, the preferred embodiment, the appended claims, and the accompanying drawings in which:

DETAILED DESCRIPTION OF THE PREFERRED EMBODIMENT

Figures 1, 2, 6:
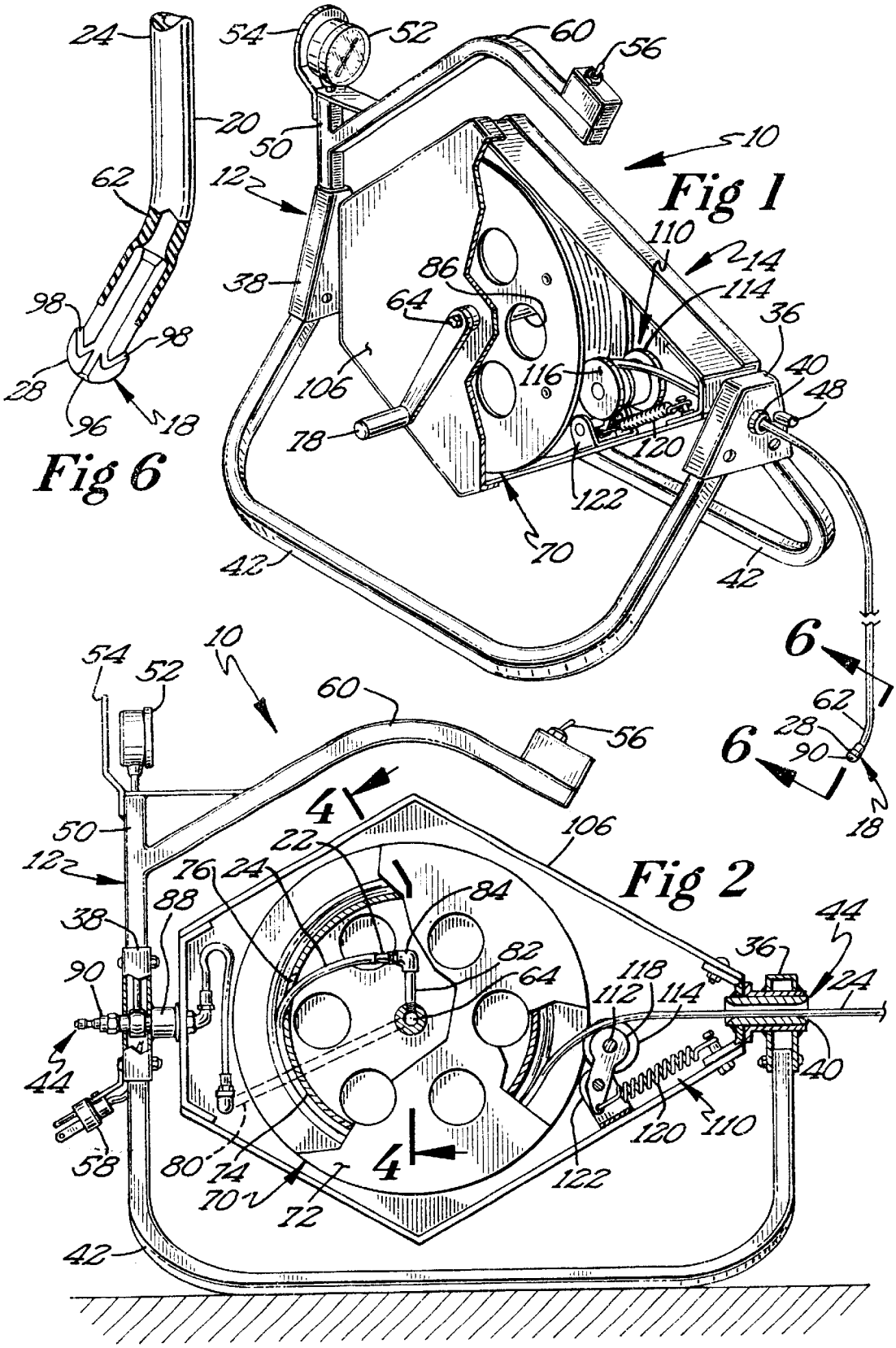
FIG. 1 is a preferred embodiment of the insertion control apparatus of the present invention with the housing of the apparatus being partially broken away to reveal the reel.
FIG. 2 illustrates a preferred embodiment of the present invention in left elevational view showing the insertion and control apparatus with the left panel of the housing of the apparatus removed to reveal the interior.
FIG. 6 is an enlarged partial longitudinally sectional view of a jet propelled high pressure nozzle in a preferred embodiment of the present invention.

The preferred embodiment of the present invention is illustrated by way of example in FIGS. 17. With specific reference to FIGS. 1 and 2, an insertion and control apparatus 10 includes a frame 12 and a storage and aiming device 14.

A stiff conduit 60 is at least partially wound inside the storage and aiming device 14. A utilization device 18 may be attached to the free end of the stiff conduit 16. In a preferred embodiment of the invention, the stiff conduit 16 is a high pressure hose 24 and the utilization device 18 is a jet propelled pressure nozzle 28.

The high pressure liquid source within a range including 4,000 lb/in$^2$ may be provided by a truck reservoir on a truck parked in the driveway of the house. A low voltage power source of about 12 V may be provided by the truck battery.

Figure 3:
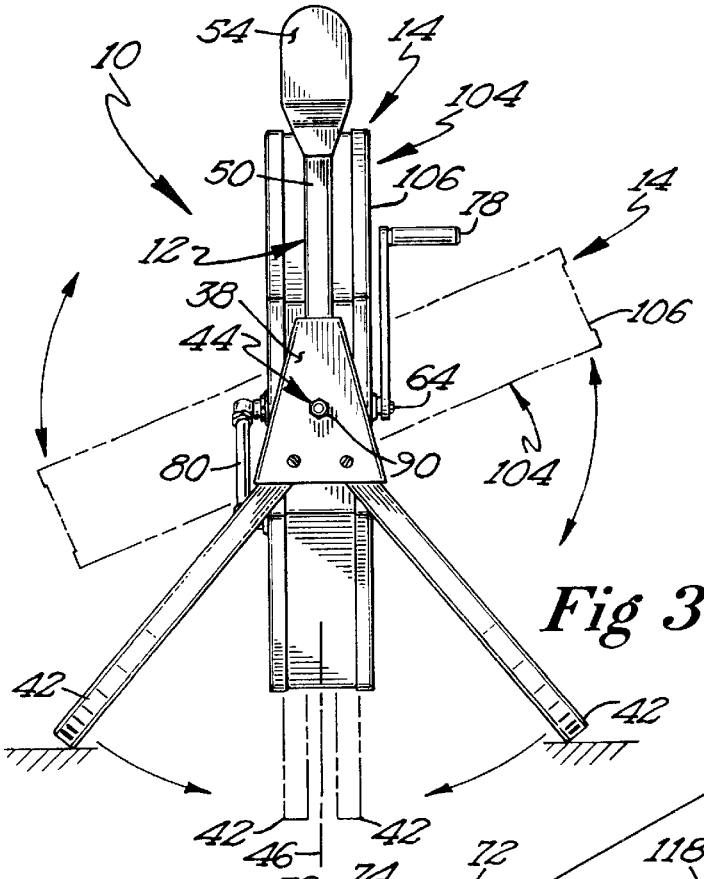
FIG. 3 illustrates a preferred embodiment of the present invention in rear elevational view showing a second position and a third position with the legs extended and folded.

The frame 12 includes a front bracket 36 and a rear bracket 38. A conduit portal 40 is placed through the front bracket 36 to permit the high pressure hose 24 to enter and leave freely from the storage and aiming device 14. Frame 12 also includes at least two legs 42. The legs 42 are foldably and rotatably mounted about a second axis 44 onto the frame 12 into the central plane 46 as shown in FIG. 3. In a preferred embodiment, the legs have a "c" shape with the free ends of the legs 42 mounted to the front bracket 36 and the rear bracket 38. Mounted above the rear bracket 38 is a post 50 for supporting a gauge 52 and gauge guard 54. The gauge 52 is used for monitoring air pressure in the high pressure reservoir on the truck. An arm 60 mounted onto the frame 12 into the central plane 46 is used for guarding the high pressure hose 24 from damage and for grasping to transport the insertion and control apparatus 10. The arm 60 is generally rectangular in shape with a curve at the apex of the apparatus 10. The arm 60 has a first end integrally connected to the post 50 and has an electrical switch 56 at the other end for turning on or off the high pressure reservoir in the truck as a safety measure in case the air pressure gauge 52 indicates a dangerous high pressure.

A predetermined length of stiff conduit 16 is constructed and arranged to be wound on and unwound from the storage and aiming device 14. The stiff conduit 16 is an elastically bendable yet substantially stiff. The stiff conduit 16 is constructed and arranged to carry fluids therealong in fluid flow relationship therewith. In the preferred embodiment of the invention, the stiff conduit 16 is a high pressure hose 24 that is constructed and arranged to retain liquid at a pressure in a range including 4,000 lb/in$^2$. The stiff conduit 16 includes a free end 20 and a connected end 22. The stiff conduit 16 has a continuous smooth and waterproof periphery. The stiff conduit 16 has a curl 62 near the free end of the stiff conduit 16 for helping control and turn the free end 20 of the stiff conduit 16.

A utilization device 18 is connected to the free end 20 of the stiff conduit 16. The utilization device 18 can be a nozzle such as a jet propelled high pressure nozzle 28. T he storage and aiming device 14 is rotatably mounted on the frame 12 about a second axis 44. The second axis 44 is offset relative to the first axis 64 for controlling the direction of the stiff conduit 16 in a pipe. The second axis 44 is also capable of being connected in communication from the inlet 90 of the storage and aiming device 14 to the connected end 22 of the stiff conduit 16. The storage and aiming device 14 includes the housing 106 the inlet 90, and a reel 70. The housing 106 is carried by storage and aiming device 14 for rotation with the storage and aiming device 14 about the second axis 44 while surrounding the reel 70 for containing the sludge. The inlet 90 is mounted on the rear bracket 38 for receiving high pressure liquid from the reservoir into the storage and aiming device 14. A channel 88 is connected at one end to the inlet 90 and at the other end abuts the housing 106 shown in FIG. 2.

The reel 70 is circular in shape, defines a central plane 46, and has a width that is less than the radius of the reel 70. The reel 70 includes a reel basket 72 and a reel floor 74. The reel floor 74 has a floor opening 76 to allow the connected end 22 of the stiff conduit 16 to pass through the reel floor 74. A lever crank 78 is connected to the reel hub 86 along the first axis 64 for winding and unwinding the stiff conduit 16 about the first axis 64. The connected end 22 of the stiff conduit 16 is attached to the storage and aiming device 14 at the conduit connector 84. A reel channel 82 connects the conduit connector 84 with channel in the interior of the reel hub 86. A water tight connection 66 connects the reel hub 86 with a handle 80. The handle 80 is connected to the channel 88 which in turn is connected to the inlet 90.

Figure 5:
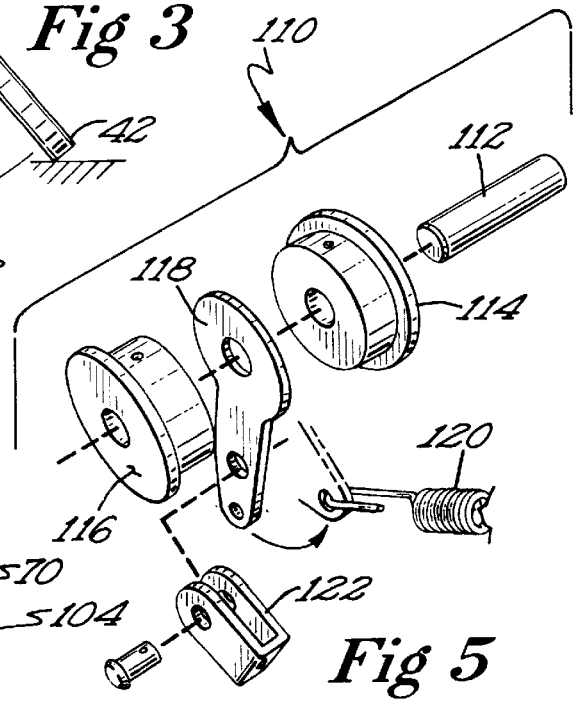
FIG. 5 in the form of an exploded slack reel illustrates a preferred embodiment of the present invention.

A slack reel 110 is located inside the storage and aiming device 14. As shown in FIG. 5 a center pin 1 12 is disposed within the center of the first side wall 114 the reel arm 118 and the second side wall 1 16. The reel arm 1 18 has one end disposed between the first side wall 1 14 and second wall 116 the other end of the reel arm 118 is biased by a spring 120. An arm bracket 122 is connected to the reel arm 118 at one end and fixedly mounted to the housing at the other end.

The storage and aiming device 14 provides several positions including a first position 100 a second position 102 and a third position 104. A first position 100 is used for dispensing stiff conduit 16 straight ahead into the pipe until the stiff conduit 16 is stopped by a turn inside the pipe. For example, the lever crank 78 positioned on the right side of the storage and aiming device 14 could be a first position 100. The second position 102 is offset from the first position 100 about the second axis 44 for turning the stiff conduit 16 around the turn to proceed forward. An example could be a lever crank 78 on the top side of the storage and aiming device. A third position 104 is offset from the second position 102 about the second axis 44 for returning the stiff conduit 16 around the turn to proceed backwards for rewinding the stiff conduit 16 back into the storage and aiming device 14. An example of a third position 104 could be the lever crank 78 on the left side of the storage and aiming device 16.

Figure 7:
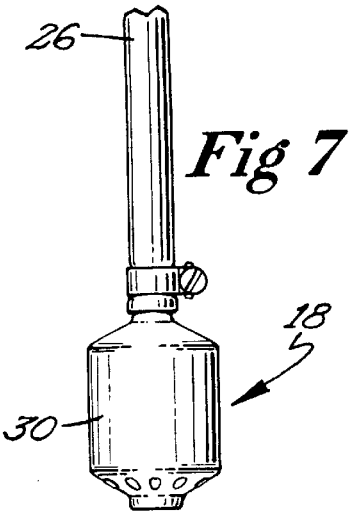
FIG. 7 in magnified form illustrates a camera and cable media in elevational view according to another embodiment of the present invention.

In another preferred embodiment of the present invention, the stiff conduit 16 is a cable media 26 such as coaxial cable or fiber optic cable. As shown in FIG. 7, the utilization device 18 is a camera 30 such as a video camera. The storage and aiming device is rotatably mounted about a first axis 64 having an electrical connection for winding and unwinding the conduit in the storage and aiming device. The second axis 44 is capable of being connected in electrical communication from the inlet 90 which is now adaptive for conventional power input to the storage and aiming device 14 to the connected end 22 of the stiff conduit 16. The electrical connection at the reel hub 86 about the first axis 64 is of a standard conventional commutator suitable for a rotational electrical connection and also including a circular mercury electrical connection.

Figure 4:
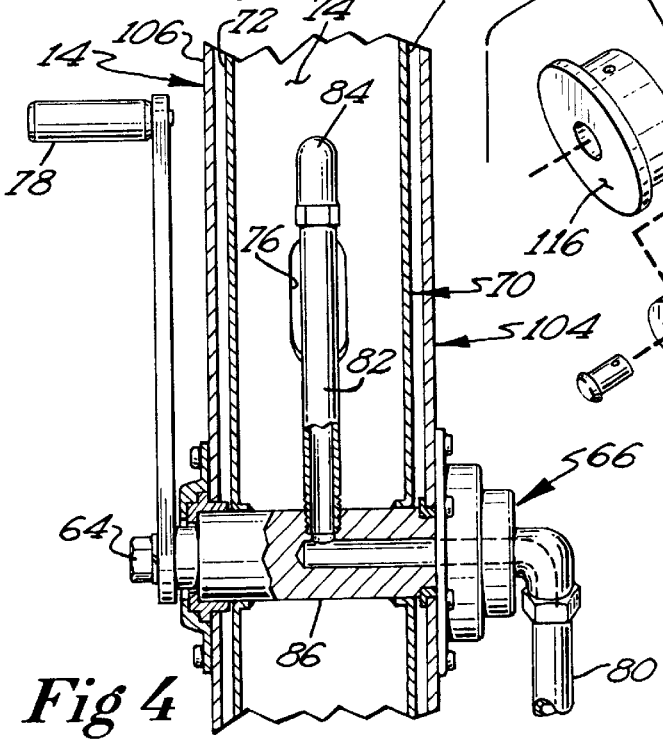
FIG. 4 is a partial longitudinally sectional view along lines 4—4 in FIG. 2.

In operation, it is best shown in FIGS. 2 and 4, cleaning fluid from the high pressure reservoir is pumped from the truck through a hose to the inlet 90 of the storage and aiming device 14. From the inlet 90, the high pressure liquid flows through the channel 88 and a hose connecting the channel 88 to the handle 80. The fluid flows through the handle 80 into a channel in the reel hub 86 along the first axis 64. The fluid then flows out the reel hub 86 through a reel channel 82 which is connected at one end to the center of the reel hub 86 and at the other end with the conduit connector 84. The high pressure fluid leaves the storage and aiming device 14 at the conduit connector 84 into the stiff conduit 16 at the connected end 22. Finally, the high pressure liquid travels through the entire length of the high pressure hose 24. From out the free end 20, the liquid exits the jet propelled high pressure nozzle 28 and enters into the pipe onto the blockage.

The pressure can be turned on or off at the truck outside by an electrical switch 56 located on the arm 60 of the insertion and control apparatus 10 from the kitchen inside.

An operator may begin dispensing the high pressure hose 24 straight ahead into the pipe until the high pressure hose is stopped by a corner inside the pipe. Any particular first position 100 will work as a starting position. However for a right handed operator, it may be convenient for the operator to place the lever crank 78 on to the right side of the storage and aiming device 14 while the operator crouches and inserts the hose by hand from the left side of the storage and aiming device 14.

If the turn inside the pipe is believed to be caused by a tee joint and the desired direction is to the right, the operator may then move the storage and aiming device 14 to a second position offset from the first position 100 about the second axis 44 for turning the high pressure hose around the 90° turn and to proceed forward. Instead of the current method twisting the high pressure hose by hand, the entire storage and aiming device 14 is turned, thereby creating a lever arm with the reel 70 for creating torque that is larger and more beneficial than the hand method. Once freed from the turn, several propulsion jets 98 and the high pressure jet nozzle 28 propel the high pressure hose 28 further along the pipe to the next turn. The housing 106 and the reel 70 are again rotated into the desired direction about a second axis 44 to control the turn of the free end 20 of the high pressure hose 24 in the desired direction. Upon reaching the obstacle in the pipe, the high pressure jet nozzle has a clearing jet 96 for removing the blockage.

Upon removal of the blockage, the storage and aiming device 14 can be rotated into a third position 104 which is offset from the second position 102 about the second axis 44 for returning the conduit to proceed backwards for rewinding the high pressure hose 24 back into the storage and aiming device 14.

The previously described embodiment of the present invention has many advantages, including relieving some torque tension and stress damage to localized areas on the high pressure hose 24. The benefit of the double axis insertion and control apparatus 10 is that it significantly reduces the damage done to stiff conduit 16 such as high pressure hoses 24. By reducing the amount and duration of localized hand torque applied to the hose 24, the invention reduces likelihood of high pressure hose 24 failure with the safety benefit of deterring the explosion of the hose 24 at 4,000 lb/in$^2$ which could cut or damage eyes of the operator. The apparatus 10 provides the economic benefit of extending the wear life of a high pressure hose 24. The replacement costs alone of a 75 foot high pressure hose 24 could be several hundred dollars. Moreover, the invention is neater and cleaner than current devices by providing the feature of a housing 106 to catch the drips and debris accumulated on the rewound hose in conjunction with providing the slack reel 110 to keep the dirty hose 24 off the floor and inside the housing 106.

While the present invention has been disclosed in connection with the preferred embodiment thereof, it should be understood that there are many other embodiments which fall within the spirit and scope of the invention as defined by the following claims. For example, the insertion and control device 10 can be used in a number of different piping systems besides plumbing systems such as vent systems, storm water drainage systems, potable water systems and fuel gas systems.

What is claimed is:

1. An insertion and control apparatus for use with a substantially stiff conduit including a free end having a curl nearby and a connected end and a pipe having turns and sludge therein and useable for carrying fluids therealong, comprising:

a frame; and a storage and aiming device being rotatably mounted about a first axis for winding and unwinding the conduit in said storage and aiming device, said storage and aiming device being rotatably mounted on said frame about a second axis, said second axis being offset relative to said first axis for controlling the direction of the stiff conduit in the pipe, said storage and aiming device including an inlet and, said storage and aiming device being capable of being connected in communication from said inlet of said storage and aiming device through said second axis and said first axis to the connected end of the stiff conduit.

2. The apparatus as recited in claim 1, wherein said storage and aiming device includes a reel.

3. The apparatus as recited in claim 2, wherein said reel has a width that is less than the radius of said reel and said reel defines a central plane, and said frame includes at least two legs, said two legs are foldably and rotatably mounted about said second axis onto said frame into said central plane.

4. The apparatus as recited in claim 3, wherein said frame includes an arm, said arm mounted onto said frame into said central plane for guarding to conduit on said reel from damage and for grasping to transport the apparatus.

5. The apparatus as recited in claim 2, wherein said storage and aiming device has a first position for dispensing conduit straight ahead into the pipe until the conduit is stopped by the turn inside the pipe; and a second position offset from said first position about said second axis for turning the conduit around the turn to proceed ahead.

6. The apparatus as recited in claim 5, wherein said storage and aiming device has a conduit rewinding third position, said third position being offset from said second position about said second axis for turning the conduit around the turn to proceed back for rewinding the conduit into said storage and aiming device.

7. The apparatus as recited in claim 2, wherein said rotatably mounted about a first axis is a watertight connection.

8. The apparatus as recited in claim 2, wherein said rotatably mounted about a first axis is an electrical connection.

9. The apparatus as recited in claim 2, wherein said storage and aiming device includes a housing, said housing being carried by said storage and aiming device for rotation with said storage and aiming device about said second axis, said housing surrounding said reel for containing the sludge.

10. The apparatus as recited in claim 2, wherein said apparatus further comprises a predetermined length of a stiff conduit, said stiff conduit being elastically bendable yet substantially stiff, said stiff conduit including a free end and a connected end, said stiff conduit having a continuous and water proof periphery, said predetermined length of said stiff conduit being constructed and arranged to be wound on and unwound from said reel.

11. The apparatus as recited in claim 9, wherein said stiff conduit has a curl near the free end of the stiff conduit.

12. The apparatus as recited in claim 11, wherein said stiff conduit is constructed and arranged to carry fluids therealong in fluid flow relationship therewith.

13.The apparatus as recited in claim 12, wherein said stiff conduit is constructed and arranged to retain liquid at a pressure over 100 pounds per square inch.

14. The apparatus as recited in claim 11, wherein said stiff conduit is a cable media.

15. The apparatus as recited in claim 14, wherein said cable media is a coaxial cable.

16. The apparatus as recited in claim 14, wherein said cable media is fiber optic cable.

17. The apparatus as recited in claim 10, further comprising a utilization device connected to the free end of said stiff conduit.

18. The apparatus as recited in claim 17, wherein said utilization device is a nozzle constructed and arranged for liquid.

19. The apparatus as recited in claim 18, wherein said nozzle is constructed and arranged for liquid at a pressure over 100 pounds per square inch, said nozzle having rearwardly projected apertures for propelling forward said nozzle.

20. The apparatus as recited in claim 17, wherein said utilization device is a camera.

21. The apparatus as recited in claim 20, wherein said camera is a video camera.

22. An insertion and control apparatus for use with a pipe having turns and sludge therein and useable for carrying fluids therealong, comprising:

a frame;

a predetermined length of a stiff conduit being elastically bendable yet substantially stiff, said stiff conduit including a free end and a connected end, said stiff conduit further including a utilization device connected to the free end of said stiff conduit, said stiff conduit having a continuous and waterproof periphery, said stiff conduit further having a curl near the free end of the stiff conduit; and a storage and aiming device rotatably mounted about a first axis for winding and unwinding the conduit in a storage and aiming device, said storage and aiming device being rotatably mounted on said frame about a second axis, said second axis being offset relative to said first axis for controlling the direction of the stiff conduit in the pipe, said storage and aiming device including a reel, a housing and an inlet, said storage and aiming device being capable of being connected in communication from said inlet of said storage and aiming device through said second axis and said first axis to the connected end of the stiff conduit, said predetermined length of said stiff conduit being constructed and arranged to be wound on and unwound from said reel, said housing being rotatably mounted to said support, said housing surrounding said reel for containing the sludge, said storage and aiming device having a first position for dispensing conduit straight ahead into the pipe until the conduit is stopped by a turn inside the pipe, said storage and aiming device further having a second position offset from said first position about said second axis for turning the conduit around the turn to proceed ahead.

23. The apparatus as recited in claim 22, wherein said stiff conduit is constructed and arranged to carry fluids therealong in fluid flow relationship therewith.

24. The apparatus as recited in claim 23, wherein said stiff conduit is a hose capable of retaining liquid at a pressure over 100 pounds per square inch.

25. The apparatus as recited in claim 22 wherein said stiff conduit is a cable media.

26. The apparatus as recited in claim 25, wherein said cable media is a coaxial cable.

27. The apparatus as recited in claim 25, wherein said cable media is a fiber optic cable.

28. The apparatus as recited in claim 22, wherein said utilization device is a nozzle constructed and arranged for liquid.

29. The apparatus as recited in claim 28, wherein said nozzle is constructed and arranged for liquid at a pressure over 100 pounds per square inch, said nozzle having rearwardly projected apertures for propelling forward said nozzle.

30. The apparatus as recited in claim 22, wherein said utilization device is a camera.

31. The apparatus as recited in claim 30, wherein said camera is a video camera.

32. The apparatus as recited in claim 22, further comprising a third position offset from said second position about said second axis for turning said conduit around the turn to facilitate rewinding the conduit backwards into said storage and aiming device.

33. The apparatus as recited in claim 22, wherein said reel has a width that is less than the radius of said reel and said reel defines a central plane;

said frame further includes at least two legs, said two legs are foldably and rotatably mounted about said second axis onto said frame into said plane, said frame includes an arm, said arm mounted onto said frame into said central plane for guarding the conduit on said reel from damage and for grasping to transport the apparatus.

34. The apparatus as recited in claim 33, wherein said frame includes a lock constructed and arranged to hold said storage and aiming device into said central plane.

* * * * *